US008162103B2

(12) United States Patent
Barrieu et al.

(10) Patent No.: US 8,162,103 B2
(45) Date of Patent: Apr. 24, 2012

(54) SILENCER FOR MOTOR VEHICLE EXHAUST LINE

(75) Inventors: Edouard Barrieu, Belfort (FR); David Gafforelli, Audincourt (FR)

(73) Assignee: Faurecia Systemes d'Echappement, Nanterre (FR)

( * ) Notice: Subject to any disclaimer, the term of this patent is extended or adjusted under 35 U.S.C. 154(b) by 0 days.

(21) Appl. No.: 12/736,538

(22) PCT Filed: Apr. 15, 2009

(86) PCT No.: PCT/FR2009/050696

§ 371 (c)(1),
(2), (4) Date: Oct. 15, 2010

(87) PCT Pub. No.: WO2009/138621

PCT Pub. Date: Nov. 19, 2009

(65) Prior Publication Data

US 2011/0031063 A1 Feb. 10, 2011

(30) Foreign Application Priority Data

Apr. 16, 2008 (FR) ..... 08 52561

(51) Int. Cl.
*F01N 1/02* (2006.01)
*F01N 1/08* (2006.01)
*F01N 1/00* (2006.01)

(52) U.S. Cl. ..... 181/249; 181/251; 181/267; 181/269; 181/268

(58) Field of Classification Search ..... 181/212, 181/239, 249, 250, 251, 255, 282, 238, 231, 181/267, 269, 268, 275
See application file for complete search history.

(56) References Cited

U.S. PATENT DOCUMENTS

| | | | | | |
|---|---|---|---|---|---|
| 552,085 | A | * | 12/1895 | Underwood | 181/239 |
| 713,536 | A | * | 11/1902 | Tobias et al. | 181/239 |
| 1,110,040 | A | * | 9/1914 | Chatain | 60/322 |
| 1,110,512 | A | * | 9/1914 | Rodwick | 181/239 |
| 1,539,967 | A | * | 6/1925 | Stockton | 181/268 |
| 1,561,859 | A | * | 11/1925 | Kemble | 181/239 |
| 1,989,675 | A | * | 2/1935 | Bobo | 181/239 |
| 2,323,891 | A | * | 7/1943 | Blanchard | 181/238 |
| 2,468,454 | A | * | 4/1949 | Mason | 181/248 |
| 2,618,355 | A | * | 11/1952 | Hedrick | 181/264 |
| 2,706,014 | A | * | 4/1955 | Carroll | 181/239 |
| 2,806,548 | A | * | 9/1957 | Carroll | 181/239 |
| 4,132,286 | A | | 1/1979 | Hasui et al. | |
| 4,842,096 | A | * | 6/1989 | Fujitsubo | 181/252 |
| 5,857,327 | A | | 1/1999 | Sato | |
| 5,949,035 | A | | 9/1999 | Herold | |
| 6,742,623 | B2 | * | 6/2004 | Tajima et al. | 181/269 |

FOREIGN PATENT DOCUMENTS

| | | |
|---|---|---|
| DE | 27 38 600 | 3/1978 |
| GB | 283 008 | 1/1928 |
| WO | WO 02/36942 | 5/2002 |

* cited by examiner

*Primary Examiner* — Edgardo San Martin
(74) *Attorney, Agent, or Firm* — Jacobson Holman PLLC

(57) ABSTRACT

This silencer (10) for a motor vehicle exhaust line of the type comprising:

a casing (12) internally delimiting an exhaust volume;

an exhaust gas inlet (16) opening into the exhaust volume; and an exhaust gas outlet pipe (18) communicating with the exhaust volume and having an outlet orifice (30) to the outside of the silencer (10), is characterized in that the outlet pipe (18) comprises a section (32) pressed against the casing (12), the casing (12) having at least one perforation placing the pressed section (32) in communication with the exhaust volume.

13 Claims, 6 Drawing Sheets

SILENCER FOR MOTOR VEHICLE EXHAUST LINE

This is a national stage of PCT/FR09/050696 filed Apr. 15, 2009 and published in France, which has a priority of France no. 0852561 filed Apr. 16, 2008, hereby incorporated by reference.

The present invention concerns a silencer for a motor vehicle exhaust line of the type comprising:

a casing internally delimiting an exhaust volume, an exhaust gas inlet opening into the exhaust volume, and an exhaust gas outlet pipe, communicating with the exhaust volume and having an outlet orifice to the outside of the silencer.

The invention also concerns a motor vehicle including such a silencer.

The exhaust gas outlet pipe of a silencer of the prior art is generally cylindrical and relatively long, the length being defined by acoustic requirements. It ends with a cannula for releasing gases into the atmosphere. The outlet pipe typically includes a portion penetrating the casing and a portion extending outside the casing.

However, the outlet pipe of such a silencer generally has a high temperature near its outlet orifice, which makes it complex to integrate the outlet pipe into a rear bumper made of plastic. It is then frequently necessary to insert a costly and complex cover between the outlet pipe and the bumper, near the outlet orifice, in order to thermally insulate the plastic bumper.

Moreover, the outlet pipe having a relatively significant predefined length, such a silencer cannot be fastened near the back of the vehicle, except in the case where the silencer is fastened in a substantially transverse direction of the vehicle, which then implies a bent shape of the outlet pipe. Such a bent shape gives the exhaust line extra back pressure, which is detrimental to the engine's performance.

The invention therefore aims to propose an exhaust line silencer that can be positioned more freely under the vehicle, and having excellent heat and sound performance.

To that end, the invention concerns a silencer of the aforementioned type, characterized in that the outlet pipe comprises a section pressed against the casing, the casing having at least one perforation placing the pressed section in communication with the exhaust volume.

According to other embodiments, the silencer comprises one or several of the following features, taken alone or according to all technically possible combinations:

the silencer comprises an outer wall outwardly fastened to the casing, the outer wall and the casing defining said pressed section of the outlet pipe between them;

the outer wall extends over more than 30% of the periphery of the casing;

the casing extends substantially in a longitudinal direction, and the outer wall extends over more than 50% of the longitudinal length of the casing;

maintenance wedges are fastened inside the pressed section of the outlet pipe between the outer wall and the casing, so as to preserve the separation between the outer wall and the casing;

the outlet pipe is completely outside the casing;

the casing comprises a tubular side wall defining opposite openings and two end walls closing the openings, and the or each perforation is formed in the side wall;

the side wall is rolled.

the tubular side wall has a central axis, the outlet orifice being positioned in a plane that is substantially parallel to the central axis;

the outlet pipe is protruding relative to the casing, substantially in a radial direction relative to the central axis;

the tubular side wall has a central axis, the outlet orifice being positioned in a plane that is substantially perpendicular to the central axis;

the outlet pipe is protruding relative to the casing, substantially parallel to the central axis;

the or each perforation formed in the side wall is substantially positioned along one or several planes that is/are substantially perpendicular to the central axis;

the outlet pipe has an orifice for discharging exhaust gas directly into the atmosphere;

the outlet orifice has a bowed shape;

the outlet orifice has a rectilinear shape;

the ratio of the height over the expanded width of the outlet orifice is less than 0.5;

along the largest part of the outlet pipe, the transverse section of said outlet pipe has a height of less than 0.5 times its expanded width;

part of the perforations is situated near the end of the outlet pipe opposite the outlet orifice.

The invention also concerns a motor vehicle characterized in that it has an exhaust line silencer as defined above.

BRIEF DESCRIPTION OF THE DRAWINGS

The invention and its advantages will be better understood upon reading the following description, provided solely as an example, done in reference to the appended drawings, in which.

Figure 1:
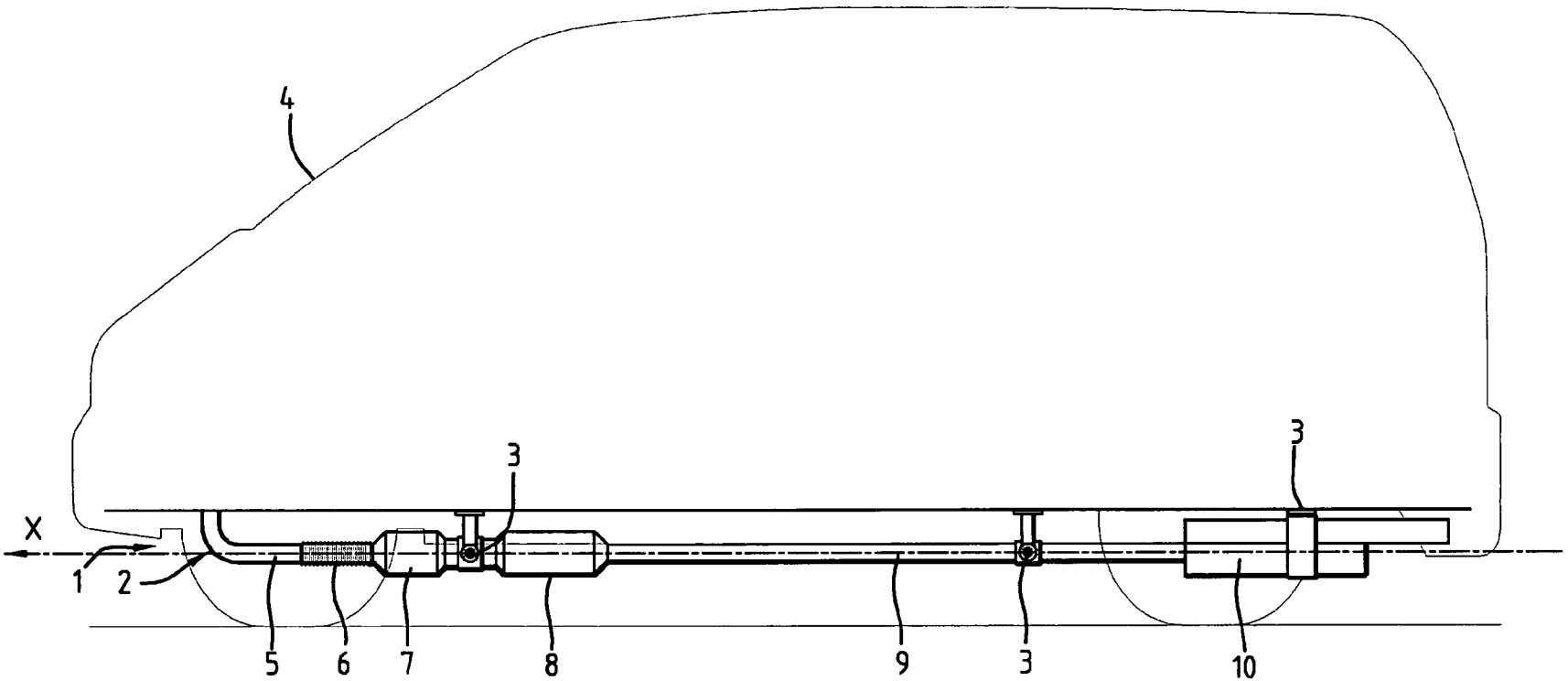
FIG. 1 is a diagrammatic illustration of an exhaust line fastened under a motor vehicle and comprising a silencer according to a first embodiment of the invention.

The exhaust line 1 illustrated in FIG. 1 has a pipe 2 and fastening means 3 for fastening the pipe 2 on the chassis of the vehicle 4.

The pipe 2 extends from the front to the back of the vehicle, in a substantially longitudinal direction corresponding to the normal direction of travel of the vehicle.

The pipe 2 includes a front end 5 for intake of exhaust gas that can be connected to an outlet of the engine. Immediately after the inlet 5, the pipe 2 has an axial uncoupler 6 typically formed by a bellows hose. The uncoupler 6 is followed, downstream, by exhaust gas pollution control members, such as a catalytic purification member 7 and a particle filter 8 spreading out, for example in this order along the length of the line.

The pollution control members 7, 8 are placed in the vicinity of the front inlet 5 of the pipe so as to have a high temperature provided by the exhaust gas.

The pipe 2 extends downstream of the pollution control members 7, 8 by a pipe 9 able to circulate under the structure of the vehicle 4. The pipe 9 has, for example, two bends in opposite directions (not shown). The length of the pipe 9 is, for example, in the vicinity of 2 meters. The pipe 9 is extended by an exhaust silencer 10.

The silencer 10 is fastened to the chassis of the vehicle 4 by the fastening means 3 substantially in the longitudinal direction of the vehicle 4. The silencer 10 is positioned near the back end of the vehicle, as shown in FIG. 1.

Figure 2:
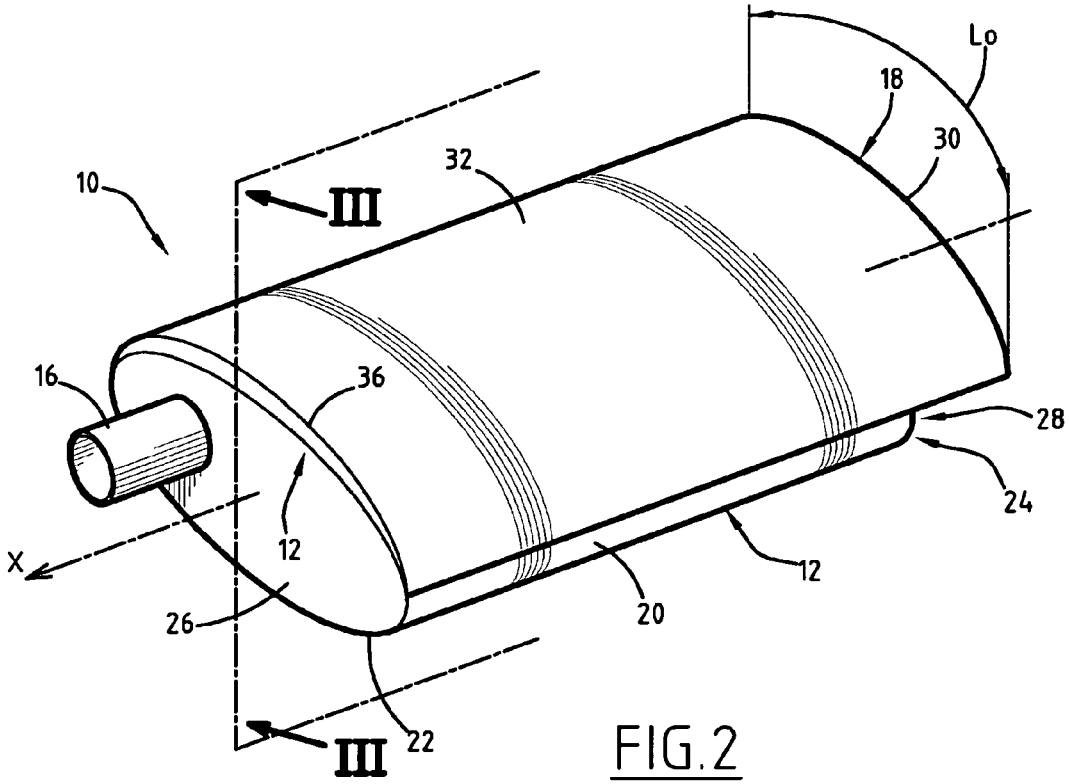
FIG. 2 is a perspective view of the silencer according to the first embodiment of the invention.
Figure 3:
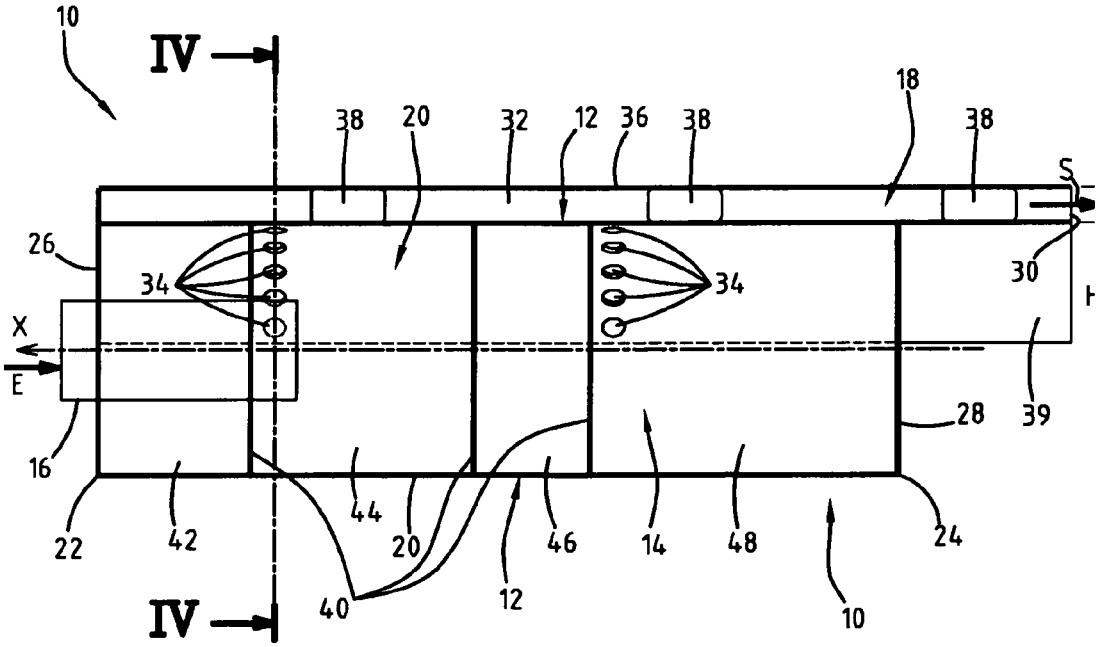
FIG. 3 is a cross-sectional view along plane III of FIG. 2.

The silencer 10 illustrated in FIG. 2 comprises a casing 12 internally delimiting an exhaust volume 14, visible in FIG. 3, an exhaust gas inlet 16 emerging in the exhaust volume 14, and an exhaust gas outlet pipe 18.

The exhaust gas inlet 16 is able to put the inner volume 14 of the silencer in communication with the upstream part of the exhaust line. The outlet pipe 18 is able to discharge the exhaust gas directly into the atmosphere, making it possible to release the gas from the exhaust gas volume 14 of the silencer into the atmosphere.

The exhaust gas circulates, from the upstream portion of the exhaust gas line towards the downstream portion, through the silencer 10 able to damp the pressure waves within the exhaust gas flow resulting from the pulsed operation of the engine.

The casing 12 comprises a tubular side wall 20 having a substantially longitudinal central axis X.

In the continuation of the description, the terms "front," "back," "longitudinal" and "transverse" are used in reference to the normal direction of travel of the vehicle. The central axis X is illustrated in FIGS. 1 to 4 and oriented from back to front.

The tubular side wall 20 delimits two opposite openings, i.e. a front opening 22 and a back opening 24.

The side wall 20 is rolled and, for example, made from a sheet metal side, the two side edges of which are fastened to each other by welding or crimping.

The casing 12 has a substantially ellipse-shaped transverse section over its entire length.

The casing 12 has two end walls 26, 28. The front end wall 26 closes the front opening 22 and the back end wall 28 closes the back opening 24.

The exhaust gas inlet 16 is a tube emerging in the exhaust volume 14, through the front end wall 26.

The outlet pipe 18 communicates with the exhaust volume 14 and has an orifice 30 for discharging exhaust gas directly into the atmosphere and towards the outside of the silencer 10. The gas discharge orifice 30 is an outlet orifice of the pipe 18.

Figure 4:
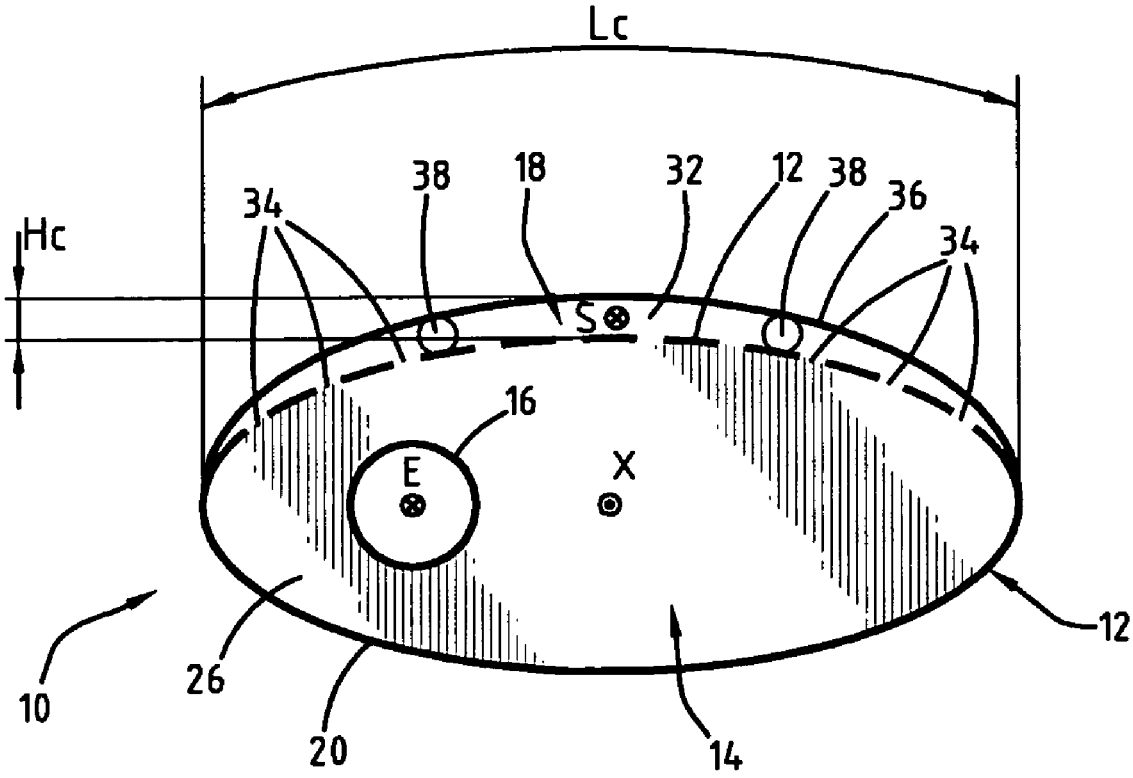
FIG. 4 is a cross-sectional view along plane IV of FIG. 3.

The outlet pipe 18 is positioned completely outside the casing 12, in the described embodiment. The outlet pipe 18 has a section 32 pressed against the outside of the casing 12. On the largest length of the pressed section 32, the outlet pipe 18 is fastened to the casing 12 while not forming any significant gap with the casing 12. The pressed section 32 communicates with the exhaust volume 14 through a plurality of perforations 34 formed in the side wall 20 of the casing 12, as illustrated in FIGS. 3 and 4.

The silencer 10 comprises an outer wall 36 outwardly fastened to the casing 12, the outer wall 36 and the casing 12 defining said pressed section 32 of the outlet pipe 18 between them.

Maintenance wedges 38 are fastened inside the outlet pipe 18, between the side wall 20 of the jacket and the outer wall 36. The wedges 38, visible in FIGS. 3 and 4, are able to maintain the separation between the side wall 20 and the outer wall 36 along the pipe 18, and to ensure mechanical stiffness of the outlet pipe 18 in relation to the casing 12.

The outlet pipe 18 protrudes in relation to the casing 12, substantially parallel to the central axis X and more precisely in relation to the back end wall 28. The protruding part has a length substantially equal to 20% of the total length of the pipe 18.

The protruding part of the pipe 18 is formed in the upper portion of the outer wall 36 and in the lower portion of a complementary wall 39, visible in FIG. 3. The outer wall 36 and the complementary wall 39 are fastened to each other on their side edges by welding or crimping. The maintenance wedges 38 are arranged between the outer wall 36 and the complementary wall 39.

The complementary wall 39 is fastened to the upper edge of the back end wall 28 by welding or crimping. The outer wall 36 is fastened to the side wall 20 by welding or crimping. The outer wall 36 and the complementary wall 39 are, for example, made by deforming a sheet metal side.

The pipe 18 has a substantially crescent moon-shaped transverse section over its entire length. In the embodiment of FIG. 4, the transverse section of the outlet pipe 18 is substantially identical along said pipe 18. It has a height Hc less than 0.5 times its expanded width Lc. The height Hc is measured in a median longitudinal plane of the casing 12, passing through the small axis of the elliptical section.

The ratio between the height Hc and the expanded width Lc of the transverse section of the outlet pipe 18 is, for example, between 0.005 and 0.1, preferably between 0.005 and 0.05, more preferably between 0.005 and 0.025.

The expanded width Lc is, for example, equal to 60 cm, and the height Hc is then between 0.3 cm and 6 cm, preferably between 0.3 cm and 3 cm, more preferably between 0.3 cm and 1.5 cm.

The outlet orifice 30 extends in a plane that is substantially perpendicular to the central axis X. In the described embodiment, the outlet orifice 30 has a bowed shape, in the shape of a crescent moon, as shown in FIG. 4. The outlet orifice 30 has a height Ho, defined in the median longitudinal plane of the casing 12, passing through the small axis of the elliptical section, and a width Lo defined as the expanded width of the orifice 30 between its two side ends, as shown in FIG. 4. The ratio of the height Ho over the width Lo of the outlet orifice 30 is less than 0.5.

The ratio between the height Ho and the width Lo of the outlet orifice 30 is, for example, between 0.005 and 0.1, preferably between 0.005 and 0.05, more preferably between 0.005 and 0.025.

The expanded width Lo of the orifice is, for example, equal to 60 cm, and the height Ho of the orifice is then between 0.3 cm and 6 cm, preferably between 0.3 cm and 3 cm, more preferably between 0.3 cm and 1.5 cm.

The perforations 34 formed in the side wall 20 of the casing are substantially positioned in two planes perpendicular to the central axis X, as shown in FIG. 3. The number of perforations 34 is, for example, equal to 20, or 10 perforations in each of the two planes perpendicular to the axis X, as illustrated in FIG. 4.

One part of the perforations 34 is situated near the front end of the outlet pipe 18, i.e. opposite the outlet orifice 30. The outlet orifice 30 is at the back end of the outlet pipe 18, as shown in FIG. 3.

The outer wall 36 extends over more than 30% of the periphery of the casing 12. In the embodiment of FIG. 2, the outer wall extends substantially over half of the periphery of the casing 12, which is situated above the large axis of the elliptical section.

The outer wall 36 extends over more than 50% of the longitudinal length of the casing 12. In the embodiment of FIG. 2, the outer wall 36 extends over substantially the entire longitudinal length of the casing 12.

Three internal partitions 40 divide the exhaust volume 14 into four chambers 42, 44, 46, 48, i.e. a first chamber 42, a second chamber 44, a third chamber 46, and a fourth chamber 48, successive from front to back and as shown in FIG. 2. The three internal partitions 40 are substantially perpendicular to the direction of the central axis X. Each internal partition 40 has openings, not shown, for communication between two chambers 42, 44, 46, 48 adjacent to each other. The chambers 42, 44, 46, 48 have different volumes.

The perforations 34 communicate with the second chamber 44 and the fourth chamber 48.

The operation of the silencer 10 will now be described in reference to FIGS. 3 and 4.

The exhaust gas from the upstream portion of the exhaust line arrives in the silencer 10 through the inlet 16 (arrow E) up to inside the second chamber 44. The pressure waves within the exhaust gas flow are damped in the second chamber 44, then part of the waves directly exits the silencer 10 through perforations 34 and the outlet pipe 18, while the other part of the waves spreads into the other chambers 42, 46, 48 via orifices formed in the internal partitions 40. The pressure waves are again damped in the other chambers 42, 46, 48 and also exit the silencer 10 via perforations 34 and the outlet pipe 18. The exhaust gas is then released into the atmosphere via the outlet orifice 30 (arrow S).

Advantageously, the outlet pipe 18 has a significant exchange surface with the outside, which allows great heat dissipation. The temperature of the outlet pipe 18 of the silencer near its outlet orifice 30 is therefore significantly reduced.

Advantageously, this temperature reduction of the outlet pipe 18 near its outlet orifice 30 causes a better distribution of the sound wave and a reduction of the jet noise.

Advantageously, the back end of the outlet pipe 18, near the outlet orifice 30, can be integrated into the plastic rear bumper of the motor vehicle, due to the low temperature of the outlet pipe 18 near its outlet orifice 30.

Advantageously, the silencer 10 effectively throttles the exhaust gas owing to the particularly long and flat shape of the outlet pipe 18.

Advantageously, the silencer 10 has a very flat shape and reduced volume, particularly adapted to motor vehicles for which the volume of the trunk is crucial.

Advantageously, the flat shape of the outlet pipe 18 makes it possible to obtain a low drag coefficient (Cx) under the motor vehicle.

Advantageously, the flat shape of the outlet pipe 18 makes it possible to connect the outlet orifice 30 with rear bumpers having an innovative design, which is an additional esthetic contribution.

Advantageously, a silencer 10 is fastened near the back end of the motor vehicle, while comprising an outlet pipe 18 having a significant length not having a bent shape, which makes it possible to guarantee good performance of the engine.

The silencer 10 according to the invention is thus designed to offer a reduced temperature of the outlet pipe 18 near its outlet orifice 30, and can be fastened near the back end of the motor vehicle, while guaranteeing good sound and engine performances.

FIGS. 5 to 9 illustrate a second embodiment, in which the elements similar to the first embodiment previously described are marked using identical references.

The silencer 10 is fastened to the chassis of the vehicle 4 by fastening means 3. It is oriented substantially in the transverse direction of the vehicle 4.

Figure 5:
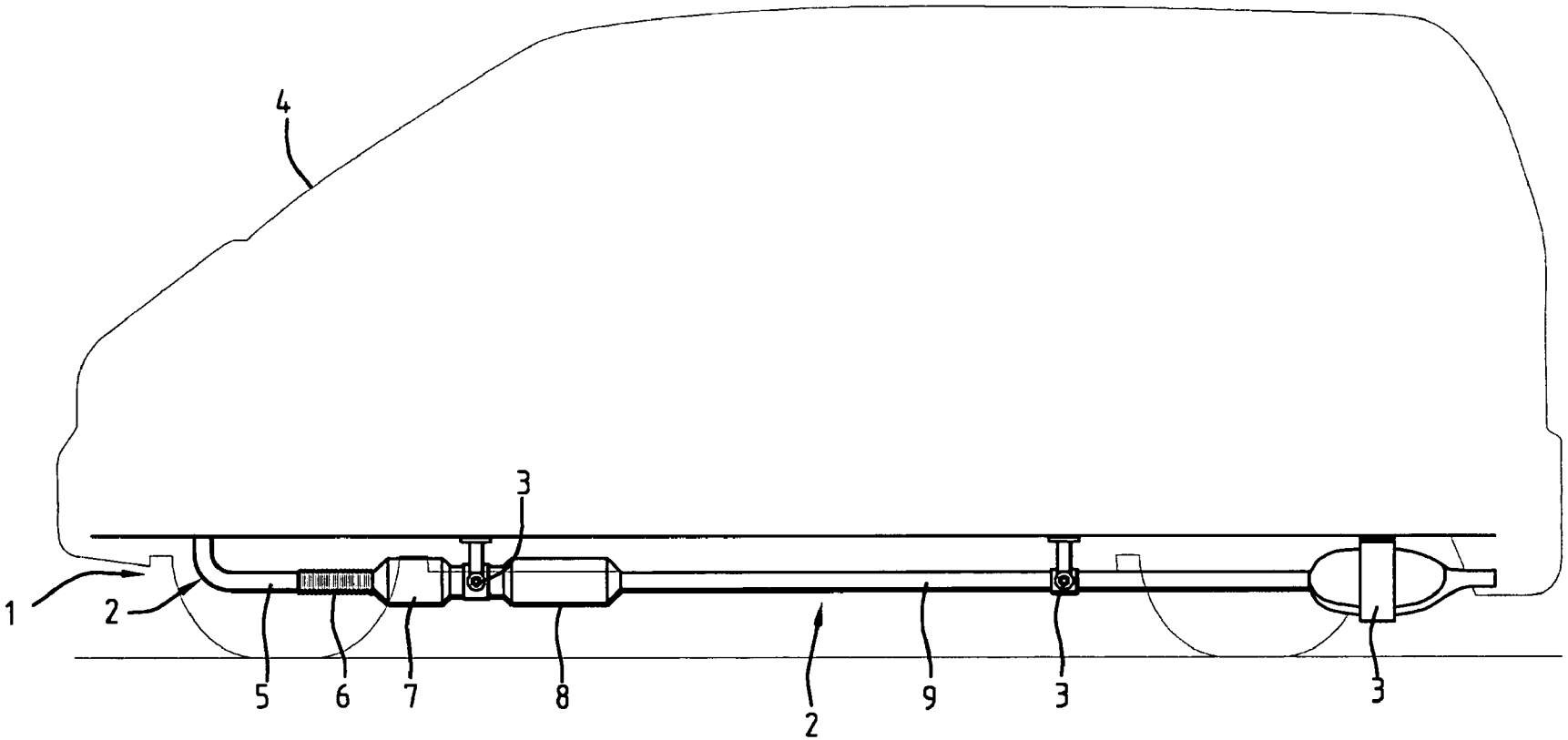
FIG. 5 is a diagrammatic illustration of the exhaust line fastened under the motor vehicle and comprising a silencer according to a second embodiment of the invention.

The silencer 10 is positioned near the back end of the vehicle, as shown in FIG. 5.

The tubular side wall 20 has a central axis Y, substantially corresponding to the transverse direction of the motor vehicle 4.

Figure 6:
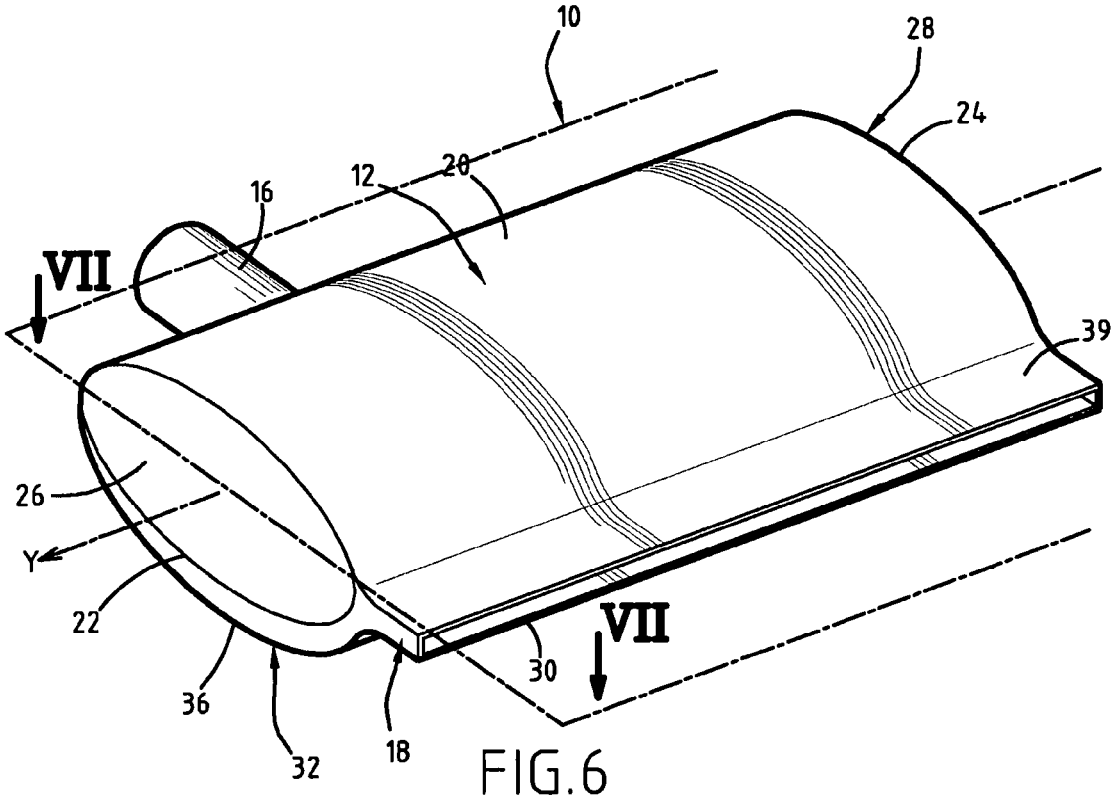
FIG. 6 is a perspective view of the silencer according to the second embodiment of the invention.
Figure 7:
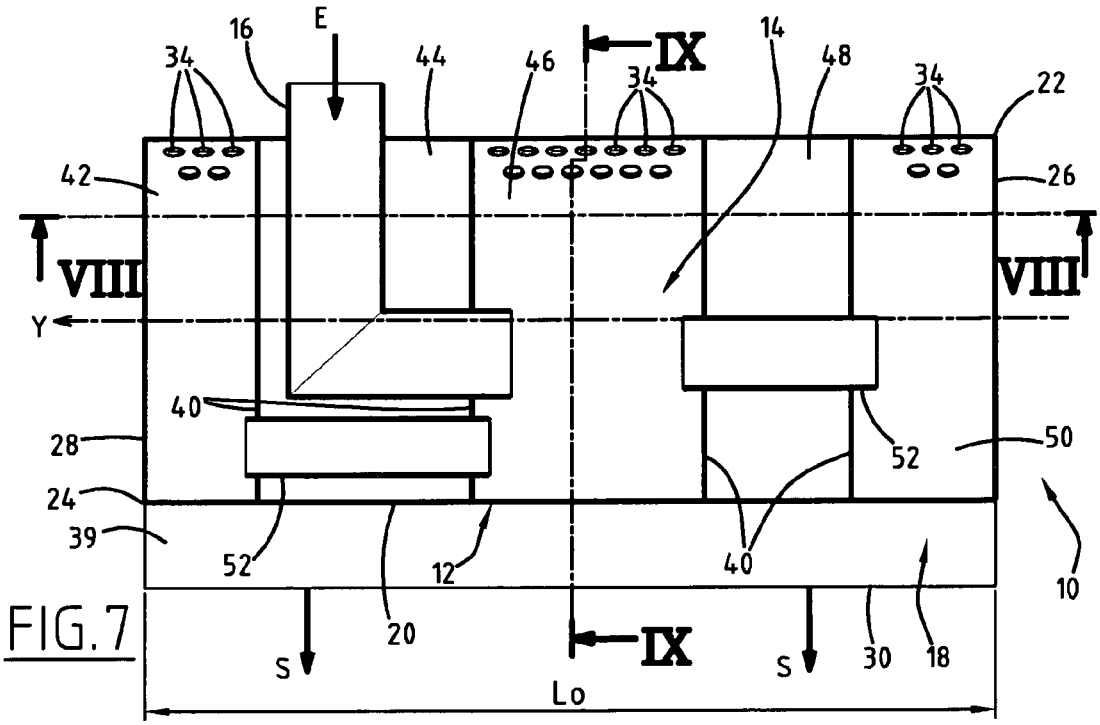
FIG. 7 is a cross-sectional view along plane VII of FIG. 6.
Figure 8:
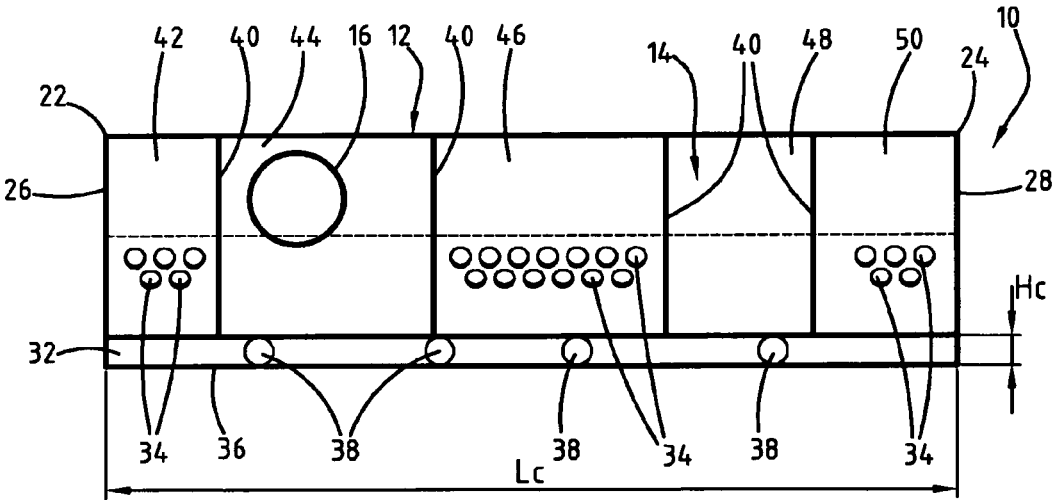
FIG. 8 is a cross-sectional view along plane VIII of FIG. 7.
Figure 9:
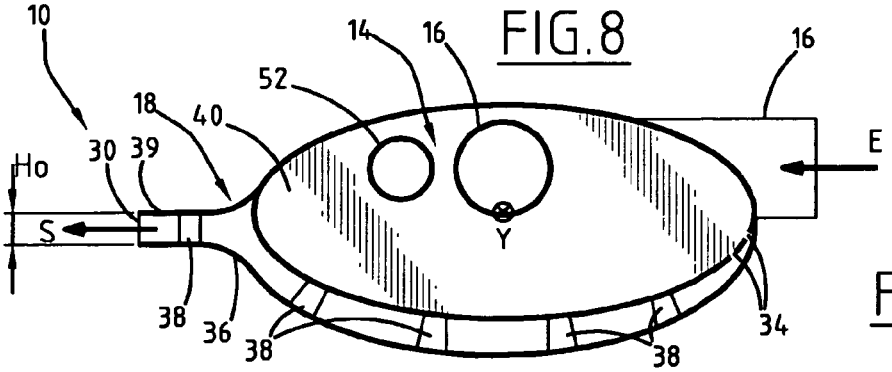
FIG. 9 is a cross-sectional view along plane IX of FIG. 7.

The central axis Y illustrated in FIGS. 6 to 7 and 9 is oriented from right to left.

The tubular side wall 20 delimits two opposite openings, i.e. a left opening 22 and a right opening 24.

The casing 12 has two end walls 26, 28. The left end wall 26 closes the left opening 22 and the right end wall 28 closes the right opening 24.

The section of the casing 12 is substantially ellipse-shaped along a plane that is perpendicular to the central axis Y.

The exhaust gas inlet 16 is a tube emerging in the exhaust volume 14, through the side wall 20, as illustrated in FIG. 7.

The outlet pipe 18 protrudes rearwardly in relation to the casing 12, in a radial direction in relation to the central axis Y, in a plane containing the central axis Y and the large axis of the elliptical section. The protruding part has a length substantially equal to 15% of the total length of the pipe 18. The length of the protruding part is defined in said radial direction, and the total length of the pipe 18 is the length defined in the circumferential circulation direction of the exhaust gas around the side wall 20.

The pipe 18 has, over its entire length, a substantially rectangular passage section. In the embodiment of FIG. 9, the passage section of the outlet pipe 18 has a height Hc less than 0.5 times its expanded width Lc over the largest portion of the length of the pipe 18. The passage section of the pipe 18 having a rectangular section, the expanded width Lc is equal to the width between the side ends of the pipe 18.

The ratio between the height Hc and the expanded width Lc of the passage section of the outlet pipe 18 is, for example, between 0.005 and 0.1, preferably between 0.005 and 0.05, more preferably between 0.005 and 0.025.

The expanded width Lc is, for example, equal to 60 cm, and the height Hc is then between 0.3 cm and 6 cm, preferably between 0.3 cm and 3 cm, more preferably between 0.3 cm and 1.5 cm.

The protruding portion of the outlet pipe 18 is formed in the lower portion of the outer wall 36, and in the upper portion of a complementary wall 39, visible in FIGS. 6 and 9. The outer wall 36 and the complementary wall 39 are fastened to each other along their side edges by welding or crimping. The complementary wall 39 is fastened to the side wall 20 by welding or crimping.

The outlet orifice 30 has an elongated shape in a direction substantially parallel to the central axis Y. In the embodiment of FIG. 6, the outlet orifice 30 is rectangular. The outlet orifice 30 has a height Ho and an expanded width Lo, the ratio of the height Ho over the width Lo of the outlet orifice 30 being less than 0.5. The outlet orifice 30 being rectangular, the expanded width Lo is equal to the width between the side ends of the outlet orifice 30.

The ratio between the height Ho and the width Lo of the outlet orifice 30 is, for example, between 0.005 and 0.1, preferably between 0.005 and 0.05, more preferably between 0.005 and 0.025.

The expanded width Lo of the orifice is, for example, equal to 60 cm, and the height Ho of the orifice is then between 0.3 cm and 6 cm, preferably between 0.3 cm and 3 cm, more preferably between 0.3 cm and 1.5 cm.

The perforations 34 formed in the side wall 20 of the casing are substantially positioned in two rows parallel to the central axis Y, as shown in FIG. 7. The number of perforations 34 is, for example, equal to 23.

The perforations 34 are situated in an area of the side wall 20 opposite its protruding portion of the outlet pipe 18, as shown in FIG. 9.

The outer wall 36 extends over more than 30% of the periphery of the casing 12. In the embodiment of FIG. 6, the outer wall extends substantially over half of the periphery of the casing 12, which is situated above the large axis of the elliptical section of the casing 12.

The outer wall 36 extends over more than 50% of the longitudinal length of the casing 12. In the embodiment of FIG. 6, the outer wall 36 extends over substantially the entire longitudinal length of the casing 12.

Four internal partitions 40 divide the exhaust volume 14 into five chambers 42, 44, 46, 48, 50, i.e. a first chamber 42, a second chamber 44, a third chamber 46, a fourth chamber 48, and a fifth chamber 50, successive from left to right and as shown in FIG. 7.

The four internal partitions 40 are substantially perpendicular to the direction of the central axis Y. The chambers 42, 44, 46, 48, 50 have different volumes.

The silencer 10 comprises two internal tubes 52, a first tube 52 for example connecting the first chamber 42 to the third chamber 46 and the second internal tube 52 for example connecting the third chamber 46 to the fifth chamber 50, as shown in FIG. 7. The inlet tube 16 communicates with the third chamber 46.

The perforations 34 communicate with the first chamber 42, the third chamber 46 and the fifth chamber 50.

The operation of this second embodiment is substantially identical to that of the first embodiment previously described, with the exception of the exhaust gas path.

The exhaust gas from the upstream portion of the exhaust line arrives in the silencer 10 through the inlet 16 (arrow E) up to inside the third chamber 46. The pressure waves are then damped in the different chambers 42, 44, 46, 48 and 50 moving substantially in the direction of the central axis Y. The exhaust gas is finally released into the atmosphere via the outlet pipe 18 and the outlet orifice 30 (arrow S), moving circumferentially around the central axis Y, as shown in FIG. 9.

Alternatively, the outlet pipe 18 is positioned partially inside the casing 12, and its expanded length is thereby increased.

Alternatively, the transverse section of the outlet pipe 18 varies along said pipe 18 and is not always identical to the section of the outlet orifice 30.

Alternatively, the outlet pipe 18 extends over the entire periphery of the side wall 20.

The casing 12 comprises, for example, a tubular side wall 20 having a central axis Y, substantially corresponding to the transverse direction of the motor vehicle. The tubular side wall 20 delimits two opposite openings, i.e. a left opening 22 and a right opening 24. The casing 12 has two end walls 26, 28. The left end wall 26 closes the left opening 22 and the right end wall 28 closes the right opening 24.

The exhaust gas inlet 16 emerges in the exhaust volume 14 through one of the two front end walls 26, 28.

The perforations 34 are formed in the side wall 20 substantially along one or several rows parallel to the central axis Y. The perforations 34 are positioned in an area of the side wall 20 on the side of the protruding portion of the outlet pipe 18.

In the pressed section 32 of the outlet pipe 18, the outer wall 36 is substantially tubular, surrounding the tubular side wall 20, maintenance wedges 38 being positioned between the side wall 20 and the outer wall 36, and ensuring a substantially constant radial separation between the side wall 20 and the outer wall 36. The outlet orifice 30 has a straight shape.

Alternatively, the outlet pipe 18 does not have a protruding portion relative to the casing 12.

Alternatively, the casing 12 is formed by two half-shells stamped and fastened to each other along their edge by welding or crimping.

According to a second aspect of the invention, independent of the first aspect of the invention described above, the outlet pipe 18 is defined between the casing 12 and the outer wall 36 outwardly fastened to the casing 12.

According to a third aspect of the invention, independent of the first two aspects of the invention that were described above, the outlet pipe 18 has an elongated section, and has a height Hc less than 0.5 times its expanded width Lc along the largest portion of its length, preferably along its entire length.

The ratio between the height Hc and the expanded width Lc of the outlet pipe 18 is, for example, between 0.005 and 0.1, preferably between 0.005 and 0.05, more preferably between 0.005 and 0.025.

The expanded width Lc is, for example, equal to 60 cm, and the height Hc is then between 0.3 cm and 6 cm, preferably between 0.3 cm and 3 cm, more preferably between 0.3 cm and 1.5 cm.

According to a fourth aspect independent of the first three aspects of the invention that were previously described, the outlet pipe 18 comprises an external part fastened spaced away from the casing 12 via fastening wedges. Said external part has a flat shape. A lower outer wall and an upper outer wall define said outer part between them. The outer walls extend over more than 30% of the periphery of the casing 12 and over more than 50% of the longitudinal length of the casing 12.

Advantageously, the outlet pipe 18 has a very significant exchange surface with the outside, which allows very great heat dissipation. The temperature of the outlet pipe 18 of the silencer near its outlet orifice 30 is therefore very significantly reduced. The temperature decrease of the pipe 18 also causes better sound wave distribution and reduced jet noise.

It is thus possible to position the silencer 10 according to the invention more freely under the vehicle, and for the silencer 10 to have excellent heat and sound performance.

The invention claimed is:

1. A silencer (10) for motor vehicle exhaust line of the type comprising:

a casing (12) internally delimiting an exhaust volume (14), an exhaust gas inlet (16) opening into the exhaust volume (14), an exhaust gas outlet pipe (18), communicating with the exhaust volume (14) and having an outlet orifice (30) to the outside of the silencer (10), and an outer wall (36) outwardly fastened to the casing (12), the outer wall (36) and the casing (12) defining the pressed section (32) of the outlet pipe (18) between them, wherein the outlet pipe (18) comprises a section (32) pressed against the casing (12), the casing (12) comprising at least one perforation (34) placing the pressed section (32) in communication with the exhaust volume (14), wherein the casing (12) comprises a tubular side wall (20) defining opposite openings (22, 24) and two end walls (26, 28) closing the openings (22, 24), the outlet pipe (18) has an outlet orifice (30) for discharging exhaust gas directly into the atmosphere, and each perforation (34) is formed in the side wall (20), and wherein the tubular side wall (20) has a central axis (Y), the outlet orifice (30) being positioned in a plane that is substantially parallel to the central axis (Y).

2. The silencer (10) according to claim 1, wherein the outer wall (36) extends over more than 30% of the periphery of the casing (12).

3. The silencer (10) according to claim 1, the casing (12) extending substantially in a longitudinal direction, wherein the outer wall (36) extends over more than 50% of the longitudinal length of the casing (12).

4. The silencer (10) according to claim 1, wherein maintenance wedges (38) are fastened inside the pressed section (32) of the outlet pipe (18) between the outer wall (36) and the casing (12), so as to preserve the separation between the outer wall (36) and the casing (12).

5. The silencer (10) according to claim 1, wherein the outlet pipe (18) is completely outside the casing (12).

6. The silencer (10) according to claim 1, wherein the side wall (20) is rolled.

7. The silencer (10) according to claim 1, wherein the outlet pipe (18) is protruding relative to the casing (12) in a substantially radial direction relative to the central axis (Y).

8. The silencer (10) according to claim 1, wherein the outlet orifice (30) has a bowed shape.

9. The silencer (10) according to claim 1, wherein the outlet orifice (30) has a rectilinear shape.

10. The silencer (10) according to claim 1, wherein the ratio of the height (Ho) over the expanded width (Lo) of the outlet orifice (30) is less than 0.5.

11. The silencer (10) according to claim 1, wherein along the largest part of the outlet pipe (18), the transverse section of said outlet pipe (18) has a height (Ho) of less than 0.5 times its expanded width (Lo).

12. The silencer (10) according to claim 1, wherein part of the perforations (34) is situated near the end of the outlet pipe (18) opposite the outlet orifice (30).

13. A motor vehicle characterized in that it has an exhaust line silencer (10) comprising:

a casing (12) internally delimiting an exhaust volume (14), an exhaust gas inlet (16) opening into the exhaust volume (14), and an exhaust gas outlet pipe (18), communicating with the exhaust volume (14) and having an outlet orifice (30) to the outside of the silencer (10), and an outer wall (36) outwardly fastened to the casing (12), the outer wall (36) and the casing (12) defining the pressed section (32) of the outlet pipe (18) between them, wherein the outlet pipe (18) comprises a section (32) pressed against the casing (12), the casing (12) comprising at least one perforation (34) placing the pressed section (32) in communication with the exhaust volume (14), wherein the casing (12) comprises a tubular side wall (20) defining opposite openings (22, 24) and two end walls (26, 28) closing the openings (22, 24), the outlet pipe (18) has an outlet orifice (30) for discharging exhaust gas directly into the atmosphere, and each perforation (34) is formed in the side wall (20), and wherein the tubular side wall (20) has a central axis (Y), the outlet orifice (30) being positioned in a plane that is substantially parallel to the central axis (Y).

* * * * *